US006034004A

United States Patent [19]

Fels et al.

[11] Patent Number: 6,034,004

[45] Date of Patent: Mar. 7, 2000

[54] PROTECTIVE CLOTHING, ESPECIALLY ANTIBALLISTIC PROTECTIVE CLOTHING FOR WOMEN

[75] Inventors: Achim Fels; Jörg Wintersieg; Michael Mohr, all of Wuppertal; Dieter Holzhauer, Heubach; Franz Palzer, Heubach-Lautern, all of Germany

[73] Assignees: Triumph International AG, Munich; Akzo Nobel Faser AG, Wuppertal, both of Germany

[21] Appl. No.: 08/765,134

[22] PCT Filed: Jun. 3, 1995

[86] PCT No.: PCT/EP95/02117

§ 371 Date: Jan. 30, 1997

§ 102(e) Date: Jan. 30, 1997

[87] PCT Pub. No.: WO96/01405

PCT Pub. Date: Jan. 18, 1996

[30] Foreign Application Priority Data

Jul. 1, 1994 [DE] Germany ..... P 4423198

[51] Int. Cl.[7] ..... B32B 05/12

[52] U.S. Cl. ..... 442/135; 442/134; 442/288; 428/911

[58] Field of Search ..... 442/134, 135, 442/288

[56] References Cited

U.S. PATENT DOCUMENTS

| | | | |
|---|---|---|---|
| 4,143,197 | 3/1979 | Jasionowicz et al. . | |
| 4,183,097 | 1/1980 | Mellian . | |
| 4,200,677 | 4/1980 | Bottini et al. . | |
| 4,457,985 | 7/1984 | Harpell et al. . | |
| 4,578,821 | 4/1986 | Zufle . | |
| 4,613,535 | 9/1986 | Harpell et al. | 428/113 |
| 4,697,285 | 10/1987 | Sylvester . | |
| 4,916,000 | 4/1990 | Li et al. | 428/105 |
| 4,953,234 | 9/1990 | Li et al. . | |
| 5,020,157 | 6/1991 | Dyer . | |
| 5,173,138 | 12/1992 | Blauch et al. | 156/177 |
| 5,354,605 | 10/1994 | Lin et al. | 428/263 |
| 5,567,498 | 10/1996 | McCarter et al. | 428/113 |
| 5,677,029 | 10/1997 | Prevorsek et al. | 428/113 |

FOREIGN PATENT DOCUMENTS

| | | |
|---|---|---|
| 089537-A1 | 9/1983 | European Pat. Off. . |
| 310199-A1 | 4/1989 | European Pat. Off. . |
| 3150858-A1 | 6/1983 | Germany . |
| 3426458-A1 | 1/1986 | Germany . |
| 3614068-C2 | 10/1987 | Germany . |
| 3743243-A1 | 6/1989 | Germany . |
| 3938741-A1 | 3/1991 | Germany . |
| 93 11 653 U | 2/1994 | Germany . |
| 1271461 | 4/1972 | United Kingdom . |
| 2144973 | 3/1985 | United Kingdom . |
| 2231481 | 11/1990 | United Kingdom . |
| WO 89/01124 | 2/1989 | WIPO . |
| WO 93/11290 | 6/1993 | WIPO . |

OTHER PUBLICATIONS

U.S. Armor Corporation Catalog, Jan. 24, 1994, "The Comfortable Choice".

Heintze, Andreas, Melliand Textilberichte, vol. 67, No. 8, 1986, pp. 529–532, "High–strength aramid fibres—their properties and applications".

Publication in "Internationale Wehrrevue", Jun. 1984, S.811.

*Primary Examiner*—Helen L. Pezzuto

*Attorney, Agent, or Firm*—Oliff & Berridge, PLC

[57] ABSTRACT

Protective clothing comprising one protective layer or a plurality of protective layers superimposed on and optionally joined to one another may contain textile flat structures made from antiballistically acting fibers, wherein the protective layers contain contoured shapes for fitting to body shapes imparted by a molding process that is conducted without the concurrent use of a resin. The protective clothing may also contain one or more cover layers. Bulges are formed in the protective layer and optionally the cover layers by the molding process in order to produce a better fit, particularly in the bust region. Protective clothing manufactured in this way offers an agreeable degree of comfort and is particularly intended for female police, military and other security personnel.

14 Claims, No Drawings

PROTECTIVE CLOTHING, ESPECIALLY ANTIBALLISTIC PROTECTIVE CLOTHING FOR WOMEN

BACKGROUND OF THE INVENTION

1. Field of the Invention

The invention relates to protective clothing, especially antiballistic protective clothing for women, consisting of cover layers and/or one or more protective layers superimposed on and possibly joined to one another, said protective layers consisting of textile flat structures made from antiballistically acting fibers.

2. Discussion of Related Art

Protective clothing providing protection against the impact of projectiles and splinters, in particular vests providing such protection, have in the recent past become standard equipment in many countries for the military, police, and other security forces. Since women are increasingly being employed in these capacities, it is necessary for this protective clothing to fit the female body shape. The conventional protective clothing designed to be worn by men poses problems for women, and its use is possible only with considerable sacrifice in wearing comfort. Particularly in a duty situation involving high physical demands, this reduced wearing comfort of protective vests developed for men becomes an extreme hindrance.

Solutions to this problem in the prior art are in part very expensive and also often do not offer the required wearing comfort. For example, U.S. Pat. No. 4,183,097 and GB-A 2 231 481 describe special cutout techniques for antiballistic women's clothing. Aside from the increased cost of producing the protective clothing and an often reduced antiballistic action, these techniques have the disadvantage that the protective vests cited are not sufficiently fitted to the female body.

Another method known in the art is to cut the bust out of antiballistic layers and sew in an appropriately prefabricated bust. Aside from the extremely high cost, this method too does not provide a satisfactory solution, since the seams protrude to some extent and moreover the antiballistic action at the seams is impaired.

Furthermore, a special breast protector has been developed for wear under a vest and is described in U.S. Pat. No. 5,020,157. Although additional breast protection is provided, wearing comfort remains unsatisfactory, since this breast protector normally is worn under a conventional vest, i.e., one containing no antiballistic layers conforming to the female body.

Finally, protective clothing is described in U.S. Pat. No. 4,578,821 in which a special breast contour for women can be placed onto a carrier material. The carrier material can be a conventional vest, for example. This solution as well does not offer sufficient wearing comfort, because the protective clothing does not sufficiently conform overall to the female body shape.

SUMMARY OF THE INVENTION

The objective therefore arose to develop protective clothing, especially antiballistic protective clothing for women, that conforms to the female body shape and therefore offers a high degree of wearing comfort without sacrificing protective action, and that moreover can be produced very cost-effectively.

Surprisingly, it has been found this objective can be met in a particularly advantageous manner when the contouring required for fitting to body shapes, such as the contour of the bust in women's protective clothing, is performed by a molding process. Aside from the possibility of manufacturing protective clothing, in particular protective clothing for women, without sacrificing protective action, the objective of providing increased wearing comfort is satisfied in a particularly advantageous manner through good-fitting protective clothing, primarily a good-fitting bust for women.

DETAILED

Thermal contouring of antiballistic packages has been described in the prior art. For example, DE-A 3 426 458 mentions this possibility for a laminate constructed from aramide-fiber woven fabrics and having a high content of polymeric binders such as polyethylene and polyvinyl resins, among others. The temperatures proposed in this case are adjusted to the resins used. Although the possibility is mentioned of contouring the resin-bonded laminates for fitting them to the body, the same publication recommends making cuts to produce biaxially rounded laminate packages, a method analogous to the conventional darting technique.

A similar technique, also using laminates and low temperatures adjusted to the resins used, is also known from the manufacture of antiballistic helmets. An example hereof is AT-B 372 524.

The processes described in the prior art use laminates. The low temperatures, which are adjusted to the resins employed and which are used in the current processes for manufacturing antiballistic protective clothing, permit contouring of textile flat structures made from aramide fibers, for example, only in a laminated structure. In the interest of providing good wearing comfort, however, it is desirable to use non-laminated woven fabrics for antiballistic protective clothing, whereby, if the protective clothing is intended for women, permanent shaping of these textile flat structures, for example in the form of individual fabrics or fabric packages, must be undertaken without concurrent use of a resin.

The protective layers of antiballistic protective clothing, particularly for bullet and splinterproof vests, often are made from aramide fibers, also known as aromatic polyamide fibers. Such fibers are commercially available under the trade name Twaron®, for example. Aramide fibers are polyamide fibers structured at least in part from aromatic compounds. In forming the polyamides, for example, by polycondensation of an aromatic amine with an aromatic acid or its chlorides, both the acid and amine components can consist either wholly or in part of aromatic compounds. Within the scope of the invention, aramide fibers are considered to be fibers comprising predominantly aromatic compounds that form amides.

In addition to aramide fibers, polyolefin fibers, particularly polyethylene fibers spun using the gel-spinning process, are used for antiballistic protective clothing. These are also suited to the manufacture of antiballistic clothing in accordance with the invention. The same applies to other antiballistically acting fibers such as so-called antiballistic nylon.

Antiballistically acting materials are understood to be those that provide resistance to penetration by projectiles, splinters, etc., and retard their speed upon impact.

Construction of antiballistically acting protective layers often uses woven fabrics made from aramide fibers. These fibers are preferably processed as filament yarns into woven fabrics, but spun yarns can also be used. Filament yarns, however, provide greater strength and improved antiballistic action.

The term protective layers is understood to mean the layers of antiballistically effective clothing that contain antiballistically acting materials as described above. Quite often, these protective layers in antiballistic clothing are aramide-fiber woven fabrics.

Antiballistic protective clothing, therefore, is understood to be clothing providing effective protection to the body from penetration by projectiles, splinters, fragments of explosive devices, etc.

Filament yarns used to manufacture woven fabrics have titers of 400–3 400 dtex. The filament titer is preferably less than 1.7 dtex.

The yarns can be processed into woven fabrics on all looms common in weaving technology. Plain-weave fabrics are preferred, but other weaves such as hopsack are possible. The thread counts required depend on the yarn titer and the desired fabric density. The following thread count figures for manufacturing woven fabric in plain weave from aramide fibers for antiballistic protective layers are to be considered as examples:

| Yarn titer dtex | Thread count per 10 cm in warp and weft | Fabric weight $g/m^2$ |
|---|---|---|
| 420 | 80–110 | 65–100 |
| 840 | 90–110 | 175–185 |
| | 120–130 | 210–220 |
| 930 | 105–115 | 200–220 |
| 1100 | 85–120 | 190–280 |
| 1260 | 75–100 | 190–250 |
| | 100–110 | 250–280 |
| 1680 | 65–80 | 220–260 |
| 3360 | 40–50 | 300–460 |

The invention, however, is not limited to the use of woven fabrics for the protective layers. In the same manner, other flat structures such as sheets, thread composites, non-woven fabrics, or knits, etc., can be used. Flat structures made from fiber materials are referred to as textile flat structures. These are understood to include woven fabrics, knits, non-woven fabrics, thread composites, etc. Woven fabrics are preferred for manufacturing the protective clothing of the invention.

Good antiballistic action in the wet state as well is required for protective vests for military or police use. Normally, this action is impaired somewhat when water, for example, accumulates between the individual aramide-fiber fabric layers. In order to also ensure good antiballistic action in the wet state or after water accumulation, it is common in many cases to subject the aramide-fiber fabrics to a water-repellent treatment, frequently also referred to as water-proofing or hydrophobization, prior to continued processing into bullet- or splinterproof vests. Preferred agents in this case are based on fluorocarbon polymers. The associated processes are well known in the textile finishing industry.

For bulletproof vests for police use, this treatment can possibly be dispensed with, since the packages of antiballistic layers are sealed between sheets of PVC and as a result are waterproof.

In the flat structures intended for protective layers, in particular in aramide-fiber woven fabrics, a bust is contoured by a molding process. Molding processes and the associated machinery are well known in the foundation garment industry. A molding process particularly well suited to the manufacture of protective layers for antiballistically effective protective clothing is described in patent application P 44 23 194.6, initially deposited with the German Patent Office concurrently with this application (corresponding to U.S. application Ser. No. 08/765,135, filed concurrently herewith and incorporated herein by reference). For aramide flat structures, the process described therein specifies temperatures of 180–300° C. at a press pressure of 4–8 bar (400–800 kPa).

According to the prior art, flat structures made from thermoplastic materials are particularly suitable for molding. Aramide fibers, which are preferred for use in antiballistic protective clothing, are not in the thermoplastic category, however, since they exhibit no defined melting and softening point and decompose before melting. It was therefore especially surprising that the process of the invention was successful in using a molding process to contour aramide-fiber flat structures and thus provide a way to fit protective clothing made from these materials to the body, particularly to the female body, in an especially advantageous manner. With the process described in patent application P 44 23 194.6, initially deposited with the German Patent Office concurrently with this application, aramide-fiber flat structures can be contoured using a molding process such that a permanent new shape is achieved and, for example, the bust in antiballistic layers for women's protective clothing can be contoured irreversibly.

After contouring of a bust, the antiballistic protective layers exhibit no loss in antiballistic effectiveness at the locations contoured using a molding process, as the bombardment tests described below indicate.

For these bombardment tests, several superimposed layers of the material to be tested are bombarded. The number of layers is chosen to conform to the conditions prevalent in bulletproof vests. Bombardment was conducted with 9 mm Para (FMJ) ammunition from a distance of 10 m at an angle of 90°. The test of antiballistic effectiveness comprised both detecting any penetration of the structure and examining the changes in a plastilina mass positioned behind the material being bombarded. In the latter case, the depth of penetration of the projectile into the plastilina mass was determined, providing an approximate measure for the energy imparted by a projectile on the human body under bombardment. A penetration depth into the plastilina mass of up to 44 mm is permitted by police authorities, depending on specification.

The bombardment tests were conducted on aramide-fiber woven fabrics in which a bust had previously been formed using the process described in patent application P 44 23 194.6, initially deposited with the German Patent Office concurrently with this application. Bombardment was directed to the contoured locations. Penetration of the areas contoured by molding was not noted in any of the tests conducted. The penetration depths into plastilina were between 26 and 42 mm and were thus under the maximum permissible limit.

The antiballistic protective layers contoured by molding are used preferably for bulletproof vests for women. In this case, between 20 and 30 of these layers are laid over one another such that the contoured busts are superimposed. Such a vest frequently contains 28 protective layers. Following contouring, the layers are joined to one another by a cross-stitch seam, whereby each of the crossed seams is approx. 10 cm long. This cross-stitch seam is applied under the contoured bust. The cross-stitching uses a sewing thread made of aramide fiber, for example. The resulting antiballistic package is then sealed into a prefabricated jacket of PVC sheeting, also with a contoured bust formed by molding, to make a bulletproof vest. Contouring of the PVC jacket is performed using molding, such that the bust is contoured in accordance with the form of the antiballistic protective layers in a two-layer PVC sheet sealed on one edge and not yet sealed on the other 3 edges. The antiballistic package is inserted into this jacket, which then has a bust on both the front and back sides, and the edge openings are sealed watertight. Then, the package sealed in PVC sheeting is inserted, for example, into a dyed or printed cotton or cotton-polyester fabric that is fitted to the contours of the antiballistic package. In the interest of providing a simplified means of removing the antiballistic package, such as when cleaning is required, the package is not completely sewn into the upper material. Rather, a means of opening and removing is created using a zipper or Velcro® fastener.

In clothing, the antiballistic protective layers are in the form of a so-called antiballistic package. This package is covered on both sides by cover layers, which can be of several different types. Within the scope of the invention, cover layers are understood to be textile or non-textile flat structures positioned under or over the package of protective layers.

Cover layers can also be, for example, PVC sheets used for sealing the antiballistic protective layers. The invention, however, is not limited to PVC sheets, however; other suitable materials can be used in the same manner. If PVC sheets are used, contouring of the bust is performed using a molding process at temperatures of 60–100° C., preferably 70–90° C. The press pressure in this case is 2–5 bar (200–500 kPa), preferably 3–4 bar (300–400 kPa).

In manufacturing women's splinterproof vests intended in particular for military use, a total of 14 layers are laid over one another such that the contoured busts are superimposed. The layers are sewn together along the edges. The resulting antiballistic package is then sewn or sealed into a prefabricated jacket, for example, of a polyester woven fabric coated on both sides with neoprene, also having a bust formed by molding. Contouring of the coated polyester fabric is conducted such that the bust is contoured by molding in a double-layer coated polyester fabric already sealed on one edge and not yet sealed on three edges. In addition to coated polyester fabrics, the jacket material can comprise other coated textile flat structures. When using coated polyester fabrics, contouring of the bust is performed using a molding process at temperatures of 180–220° C., preferably 190–210° C. The selected press pressure in this case is 5–7 bar (500–700 kPa), preferably 5.5–6.5 bar (550–650 kPa). The antiballistic package is then inserted into this jacket, which has a bust on the front and back sides, and the remaining side openings are sewn shut or sealed. The package sealed or sewn into a coated polyester fabric or another coated textile flat structure is then inserted into, for example, a dyed or printed cotton or cotton-polyester fabric fitted to the contours of the antiballistic package.

The protective clothing of the invention offers female security personnel a high degree of wearing comfort, resulting from a bust contoured in the protective and cover layers by a molding process, and does not restrict freedom of movement. The protective clothing of the invention thus represents a considerable step forward in the manufacture of protective clothing, in particular of protective vests for female security personnel, without a sacrifice in protective action.

EXAMPLES

Example 1

A woven fabric was manufactured from aramide-fiber filament yarns with a titer of 930 dtex in plain weave. The thread counts were 10.7/cm in warp and 10.5/cm in weft. The resultant fabric had a weight of 202 g/m$^2$ and a thickness of 0.30 mm. Cutouts were made from this fabric for protective vests. In each of these cutouts individually, a bust was formed using the molding process described in patent application P 44 23 194.6, initially deposited with the German Patent Office concurrently with this application. A total of 28 layers of these cutouts were incorporated as a package and sealed into a PVC jacket, in which a bust had also been formed previously by deep-drawing. The resulting antiballistic package was subjected to a bombardment test conforming to the conditions cited above, whereby the bombardment was also directed to the contoured areas. Of a total of 4 direct hits, none penetrated at the molded locations. The penetration depths into plastilina were between 26 and 37 mm. The German police specifications for use as protective clothing were thereby fully met.

Further bombardment tests, in each case directed to the areas contoured by molding, were performed on packages with varying numbers of antiballistic layers. The following results were obtained:

| Number of layers | Penetration | Penetration depth mm |
|---|---|---|
| 30 | no | 30 |
| 28 | no | 31 |
| 26 | no | 36 |

These results show that, even with a reduced number of antiballistic layers in a vest, the requirements imposed on bulletproof vests were fully satisfied even at the contoured locations.

Example 2

A woven fabric was manufactured from aramide-fiber filament yarns with a titer of 1 100 dtex in plain weave. The thread counts were 8.7/cm in warp and 8.3/cm in weft. The resulting fabric had a weight of 189 g/m$^2$ and a thickness of 0.30 mm. From this fabric, cutouts for protective vests were made. A bust was contoured in each of these cutouts individually using the molding process described in patent application P 44 23 194.6, initially deposited with the German Patent Office concurrently with this application. A total of 14 layers of these cutouts were incorporated as a package and sewn together along the edges for the bombardment test. The resulting antiballistic package was subjected to a splinter bombardment as specified by STANAG 2920. The bombardment was conducted with 1.1 g splinters. Bombardment of the package in the dry state at the locations contoured by molding resulted in a V50 value of 467 m/sec. This value indicates that the probability of penetration is 50% at the given speed. The V50 value at the uncontoured locations was 466 m/sec. In bombardment in the wet state as well, practically the same values were noted at the contoured and uncontoured locations. The V50 values were 437 m/sec at the contoured locations and 436 m/sec at the uncontoured locations. This example shows, as does the preceding one, that contouring of the protective layers by molding has no negative influence on the antiballistic action of the protective clothing.

What is claimed is:

1. Protective clothing comprising one protective layer or a plurality of protective layers superimposed on and optionally joined to one another, said protective layer(s) consisting of textile flat structures made from antiballistically acting fibers, wherein said protective layer(s) contain contoured shapes for fitting to body shapes, said contoured shapes being imparted by a molding process, wherein said protective layer(s) are molded to impart contoured shapes without the concurrent use of a resin.

2. Protective clothing according to claim 1, wherein in that said protective layers consist of textile flat structures made from aramide fibers.

3. Protective clothing according to claim 1, wherein said protective layers consist of woven fabrics made from aramide fibers.

4. Protective clothing according to claim 1, wherein said protective clothing is antiballistic protective clothing for women.

5. Protective clothing according to claim 1, wherein said protective clothing is for women and comprises a bust contoured by a molding process in said protective layer(s).

6. Protective clothing according to claim 1, wherein said protective clothing is bullet-inhibiting protective clothing for women, wherein the protective layer(s) are antiballistically effective, the antiballistically effective protective layer (s) being sealed into a jacket of polyvinyl chloride sheeting, and wherein both said protective layer(s) and said jacket have a bust contoured by a molding process.

7. Protective clothing according to claim 1, wherein said protective clothing is splinter-inhibiting protective clothing for women, wherein the protective layer(s) are antiballistically effective, the antiballistically effective protective layer (s) being sealed into a jacket of polyvinyl chloride sheeting, and wherein both said protective layer(s) and said jacket have a bust contoured by a molding process.

8. Protective clothing according to claim 6, wherein said bullet-inhibiting protective clothing for women is a bulletproof vest.

9. Protective clothing according to claim 7, wherein said splinter-inhibiting protective clothing for women is a splinterproof vest.

10. Protective clothing according to claim 1, further comprising cover layers.

11. Protective clothing according to claim 10, wherein said cover layers contain contoured shapes for fitting to the body.

12. Protective clothing according to claim 11, wherein said contoured shapes are imparted by a molding process.

13. Protective clothing according to claim 1, wherein said molding process is conducted at a temperature of from 180 to 300° C.

14. Protective clothing according to claim 13, wherein said molding process is conducted at a pressure of from 400 to 800 kPa.

* * * * *

UNITED STATES PATENT AND TRADEMARK OFFICE

CERTIFICATE OF CORRECTION

PATENT NO. : 6,034,004

DATED : March 7, 2000

INVENTOR(S) : Achim FELS, Jörg WINTERSIEG, Michael MOHR, Dieter HOLZHAUER and Franz Palzer It is certified that error appears in the above-indentified patent and that said Letters Patent is hereby corrected as shown below:

Column 2, line 9, change "DETAILED" to --DETAILED DESCRIPTION OF PREFERRED EMBODIMENTS--; and line 40, change "bullet", to -- bullet- --.

Column 7, lines 6-7, delete "in that".

Signed and Sealed this

First Day of May, 2001

*Attest:*

Nicholas P. Godici

NICHOLAS P. GODICI

*Attesting Officer*

*Acting Director of the United States Patent and Trademark Office*